US009320341B2

(12) United States Patent
Majeau

(10) Patent No.: US 9,320,341 B2
(45) Date of Patent: Apr. 26, 2016

(54) INTERIOR CRADLE FOR A PORTABLE ELECTRONIC DEVICE

(75) Inventor: Bernard H. Majeau, Highlands Ranch, CO (US)

(73) Assignee: eBags, Inc., Greenwood Village, CO (US)

( * ) Notice: Subject to any disclaimer, the term of this patent is extended or adjusted under 35 U.S.C. 154(b) by 1119 days.

(21) Appl. No.: 13/029,933

(22) Filed: Feb. 17, 2011

(65) Prior Publication Data

US 2011/0198374 A1 Aug. 18, 2011

Related U.S. Application Data

(60) Provisional application No. 61/305,273, filed on Feb. 17, 2010.

(51) Int. Cl.

| | |
|---|---|
| ***A45F 5/00*** | (2006.01) |
| ***A45C 5/00*** | (2006.01) |
| ***A45F 3/04*** | (2006.01) |
| *A45C 13/02* | (2006.01) |

(52) U.S. Cl.

CPC ..... *A45F 3/04* (2013.01); *A45C 2013/025* (2013.01); *A45F 2200/0525* (2013.01)

(58) Field of Classification Search

CPC ..... A45F 2200/0525; A45F 5/00; A45C 2011/003; A45C 5/00

USPC ..... 224/653, 930, 196; 190/100, 110

See application file for complete search history.

(56) References Cited

U.S. PATENT DOCUMENTS

| | | | | | |
|---|---|---|---|---|---|
| 1,206,124 | A | * | 11/1916 | Meyers | B65D 85/1009 206/254 |
| 2,585,745 | A | | 2/1952 | Crosby | |
| 4,265,286 | A | * | 5/1981 | Rapoport | 190/108 |
| D270,306 | S | | 8/1983 | Stark | |
| D270,872 | S | | 10/1983 | Katz et al. | |
| D280,266 | S | | 8/1985 | Allen | |
| 4,541,556 | A | * | 9/1985 | Collins | B26B 29/025 206/250 |
| D283,465 | S | | 4/1986 | Allen | |
| D292,747 | S | | 11/1987 | Allen | |
| 4,854,432 | A | * | 8/1989 | Carpenter et al. | 190/110 |
| 5,002,184 | A | | 3/1991 | Lloyd | |
| 5,010,988 | A | | 4/1991 | Brown | |
| D325,128 | S | | 4/1992 | Cyr et al. | |

(Continued)

FOREIGN PATENT DOCUMENTS

| | | |
|---|---|---|
| JP | 09-009832 | 1/1997 |
| JP | 10-201512 | 8/1998 |

(Continued)

OTHER PUBLICATIONS

Brenthaven Topload Case, www.Brenthaven.com, last updated Jun. 2003, 1 page.

(Continued)

*Primary Examiner* — Justin Larson

(74) *Attorney, Agent, or Firm* — Perkins Coie LLP

(57) ABSTRACT

A storage device for portable electronic devices is provided. The storage device includes a luggage item provided with an interior cradle. The interior cradle is adapted to securely and adjustable hold a portable electronic device, such as a laptop computer. The interior cradle comprises a height adjuster for selectively changing the position or depth of the stored device within the bag.

19 Claims, 7 Drawing Sheets

(56) References Cited

U.S. PATENT DOCUMENTS

| | | | | |
|---|---|---|---|---|
| 5,160,001 | A * | 11/1992 | Marceau | 190/102 |
| 5,217,119 | A | 6/1993 | Hollingsworth | |
| D338,104 | S | 8/1993 | Lee | |
| D346,694 | S | 5/1994 | Cyr et al. | |
| D346,901 | S | 5/1994 | Dulka et al. | |
| 5,325,970 | A | 7/1994 | Dillon et al. | |
| 5,341,973 | A * | 8/1994 | Dawes | A45F 3/04 221/185 |
| 5,400,903 | A | 3/1995 | Cooley | |
| D358,483 | S | 5/1995 | Cross et al. | |
| D358,935 | S | 6/1995 | Chang et al. | |
| D360,075 | S | 7/1995 | Cross et al. | |
| D360,978 | S | 8/1995 | Willard et al. | |
| 5,524,754 | A * | 6/1996 | Hollingsworth | 206/320 |
| D375,629 | S | 11/1996 | Chen | |
| 5,607,054 | A | 3/1997 | Hollingsworth | |
| D379,267 | S | 5/1997 | Roegner | |
| D380,612 | S | 7/1997 | Kelley et al. | |
| D381,201 | S | 7/1997 | Miller et al. | |
| 5,676,223 | A * | 10/1997 | Cunningham | 190/109 |
| 5,678,666 | A * | 10/1997 | Shyr et al. | 190/102 |
| D391,076 | S | 2/1998 | Test | |
| D396,144 | S | 7/1998 | Farmer | |
| D399,056 | S | 10/1998 | Tawil | |
| D401,063 | S | 11/1998 | Yamamoto et al. | |
| D405,957 | S | 2/1999 | Test | |
| 5,875,876 | A * | 3/1999 | Wang | 190/18 A |
| 5,884,768 | A | 3/1999 | Fox | |
| 5,887,777 | A | 3/1999 | Myles et al. | |
| D409,385 | S | 5/1999 | Pearson et al. | |
| 5,931,270 | A | 8/1999 | Mitchell | |
| 5,938,096 | A | 8/1999 | Sauer et al. | |
| D414,935 | S | 10/1999 | Bould | |
| D415,347 | S | 10/1999 | Imbert | |
| D417,782 | S | 12/1999 | Tawil | |
| 6,000,509 | A * | 12/1999 | Chisholm | 190/109 |
| 6,098,769 | A * | 8/2000 | Yen | 190/108 |
| 6,105,764 | A | 8/2000 | Scicluna et al. | |
| 6,131,734 | A | 10/2000 | Hollingsworth et al. | |
| 6,145,661 | A | 11/2000 | Jung | |
| D434,901 | S | 12/2000 | Eskandry | |
| D435,591 | S | 12/2000 | Wyant | |
| D437,115 | S | 2/2001 | Hillman | |
| D441,533 | S | 5/2001 | Tawil | |
| 6,237,766 | B1 | 5/2001 | Hollingsworth | |
| D443,417 | S | 6/2001 | Hillman | |
| D443,983 | S | 6/2001 | Hillman | |
| D445,252 | S | 7/2001 | Klamm | |
| 6,257,407 | B1 | 7/2001 | Truwit et al. | |
| 6,267,236 | B1 | 7/2001 | Seok | |
| D447,631 | S | 9/2001 | Hillman | |
| 6,334,533 | B1 | 1/2002 | Hollingsworth et al. | |
| 6,334,534 | B1 | 1/2002 | Hollingsworth et al. | |
| 6,352,155 | B1 | 3/2002 | Barber | |
| 6,390,297 | B1 | 5/2002 | Hollingsworth | |
| D458,749 | S | 6/2002 | Bruni et al. | |
| D459,884 | S | 7/2002 | King | |
| 6,467,594 | B1 * | 10/2002 | Wu | 190/108 |
| 6,547,071 | B2 | 4/2003 | Barber | |
| 6,604,618 | B1 * | 8/2003 | Godshaw et al. | 190/107 |
| D479,652 | S | 9/2003 | Hassett | |
| 6,655,528 | B2 | 12/2003 | King | |
| 6,691,843 | B2 | 2/2004 | Nykoluk et al. | |
| 6,745,897 | B2 | 6/2004 | Barber et al. | |
| D500,204 | S | 12/2004 | Hillman | |
| 6,827,185 | B2 | 12/2004 | Scicluna | |
| D500,597 | S | 1/2005 | Hillman | |
| D500,923 | S | 1/2005 | Gonzalez et al. | |
| 6,837,346 | B2 | 1/2005 | Hollingsworth | |
| 6,899,346 | B2 * | 5/2005 | Pfeiffer | 280/47.29 |
| D506,609 | S | 6/2005 | Hillman | |
| 6,977,809 | B2 | 12/2005 | Bovino | |
| 7,036,642 | B2 | 5/2006 | Hobermon et al. | |
| 7,540,378 | B2 | 6/2009 | Gallagher | |
| 7,588,146 | B1 * | 9/2009 | Salander et al. | 206/320 |
| 7,699,196 | B2 * | 4/2010 | Szabo | A45F 5/021 224/196 |
| 8,151,981 | B2 * | 4/2012 | Nordstrom | A45C 7/0077 206/254 |
| 2002/0027052 | A1 * | 3/2002 | Godshaw et al. | 190/111 |
| 2004/0134813 | A1 | 7/2004 | Domotor | |
| 2004/0188202 | A1 * | 9/2004 | Chuang | 190/110 |
| 2005/0161301 | A1 * | 7/2005 | Hoberman et al. | 190/110 |
| 2005/0189188 | A1 | 9/2005 | Barnes | |
| 2005/0284791 | A1 | 12/2005 | Sadow | |
| 2007/0228097 | A1 * | 10/2007 | Recanati | 224/580 |
| 2008/0087513 | A1 * | 4/2008 | Majeau | 190/111 |

FOREIGN PATENT DOCUMENTS

| | | |
|---|---|---|
| JP | 10-290703 | 11/1998 |
| JP | 10-290706 | 11/1998 |
| JP | 11-018591 | 1/1999 |

OTHER PUBLICATIONS

Case It Catalog, 2001, p. 5.

Case Logic 16" Laptop Backpack, Case Logic, Inc. website at http://www.caselogic.com/16_laptop_backpack/product_detail/index.cfm?modelid=208560&productid=10121097, copyright 2010, printed May 12, 2011, 4 pages.

Case Logic Case Connect Catalog, 1992, pp. 4-5.

Case Logic Catalog, 2001, p. 23.

Case Logic Catalog, 2002, pp. 18-19.

Case Logic Catalog, 2003, pp. 10-11.

Case Logic SLR Camera Backpack, Case Logic, Inc. website at http://www.caselogic.com/slr_camera_backpack/product_detail/index.cfm?modelid=211092&productid=10128428, copyright 2010, __ pages.

J & R Music-Computer World Catalog, Laptop Computer Bags, 2002, p. 145.

Kensington Contour Pro XBrace Carrying Case, www.kensington.com, last updated Jun. 2003, 2 pages.

Lowepro Catalog, 2000, pp. 39, 57.

* cited by examiner

INTERIOR CRADLE FOR A PORTABLE ELECTRONIC DEVICE

This application claims the benefit of U.S. Provisional Patent Application Ser. No. 61/305,273, filed on Feb. 17, 2010, the entire disclosure of which is hereby incorporated by reference.

FIELD OF THE INVENTION

Embodiments of the present invention are generally related to notebook/laptop computer storage solutions. More specifically, one embodiment of the present invention is a backpack or attaché having an interior cradle adapted to securely hold a laptop computer and including a height adjustment mechanism for selectively changing the position of the laptop within the confines of the backpack or attaché.

BACKGROUND

Electronic devices such as notebook/laptop computers are becoming commonplace for a wide variety of society. These electronic devices include, but are not limited to laptops, gaming devices, photography equipment, iPads, tablet PCs, e-readers, wireless reading devices, Kindles, portable movie players, etc. The popularity of these electronic devices has expanded from the traditional base of business travelers to commuters, photographers, students, children, gamers, travelers, and other persons who simply enjoy the convenience of bringing and having their electronic devices with them. Unfortunately, typical bags/cases are configured as formal briefcases or attaches. It is often necessary or desirable, however, to store an electronic device in something less formal and with other storage capabilities. Thus, it would be advantageous to provide an electronic device storage solution which is appealing to a broad range of people, business and non-business persons alike. Although some electronic device storage solutions are integrated into carrying bags, these bags are oversized and bulky.

Moreover, these bags typically have separate device compartments which result in a significant loss of packing volume when unused. Thus, it is important to provide a device storage solution which unobtrusively yet stably maintains the device in a fixed position within the carrying bag. Furthermore, backpacks having electronic device storage solutions typically do not allow for a height adjustment of the device against a user's back. This is undesirable because user's having different heights and/or back injuries are prohibited from positioning the device at a favorable and more comfortable height. Thus, it would be advantageous to provide an electronic device storage solution having a height adjustment mechanism for selectively changing the position of the device within the backpack. It would be advantageous to provide an electronic device storage solution that avoids the above-mentioned deficiencies of the prior art and provides a low-profile, secure and adjustable device storage solution in a versatile bag. Similar subject matter has been disclosed in U.S. Pat. No. 5,217,119, U.S. Pat. No. 7,036,642, U.S. Pat. No. 6,827,185, U.S. Pat. No. 6,691,843, and U.S. Publication No. 2005/0189188, all of which are incorporated by reference herein in their entirety.

SUMMARY OF THE INVENTION

It is one aspect of the present invention to provide an electronic device storage solution. More specifically, the storage solution of one embodiment of the present invention is integrated into a luggage item, such as a carrying case, which may be configured as, a backpack, an attaché, a briefcase, a sack, a tote bag, a messenger bag, a book bag, baggage/luggage or other travel bag such as, a weekender (hereinafter "the weekender"). The weekender has an interior cradle configured to unobtrusively and conveniently secure an electronic device in the bag. In one embodiment, the height of the interior cradle is selectively adjustable to accommodate a wide range of device sizes. Moreover, the height of the cradle is selectively adjustable to adjust comfortably to a user's back. When a user is wearing the weekender like a backpack, the user is able to access the cradle and can thus easily remove the electronic device while the weekender is full. Preferably, the interior cradle is interconnected to the back panel of the bag. The interior cradle is accessed from the top of the bag which reduces the risk of unintended spillage and centralizes the weight distribution. In one embodiment of the present invention, the weekender bag preferably includes a padded back panel for added shock protection. The weekender bag of one embodiment also includes a plurality of strap and handle options for easy carrying and transport of the bag.

In a preferred embodiment, a storage system is provided which comprises a flexible interior cradle adapted to wrap around at least a portion of a portable electronic device. The interior cradle generally has a first end, a second end, and a width. In various embodiments, the width may be tapered or variable along a length of the cradle. Furthermore, an adjustable strap is provided for securing and adjusting at least a vertical position of said cradle. Preferably, the strap has a first end interconnected to a luggage panel and a second end comprising a buckle portion or similar fastening means for selective communication with the cradle. Similarly, one end of the interior cradle is operably interconnected to a luggage panel and the opposing end adapted for selective communication with the aforementioned strap.

In a preferred embodiment, the adjustable strap is provided to alter the storage height of a portable electronic device retained within the interior cradle when the strap and the cradle portions are engaged with one another. Preferably, the cradle is positioned such that its lowermost portion resides in a vertical position that is higher than a lowermost portion of the bag, such that impact will not be imparted directly upon the device in the event that the bag is dropped.

The Summary of the Invention is neither intended nor should it be construed as being representative of the full extent and scope of the present invention. The present invention is set forth in various levels of detail in the Summary of the Invention as well as in the attached drawings and the Detailed Description of the Invention and no limitation as to the scope of the present invention is intended by either the inclusion or non-inclusion of elements, components, etc. in this Summary of the Invention. Additional aspects of the present invention will become more readily apparent from the Detailed Description, particularly when taken together with the drawings.

BRIEF DESCRIPTION OF THE DRAWINGS

The accompanying drawings, which are incorporated in and constitute a part of the specification, illustrate various embodiments of the invention and together with the general description of the invention given above and the detailed description provided below, serve to explain the principles of these inventions.

Figure 1:
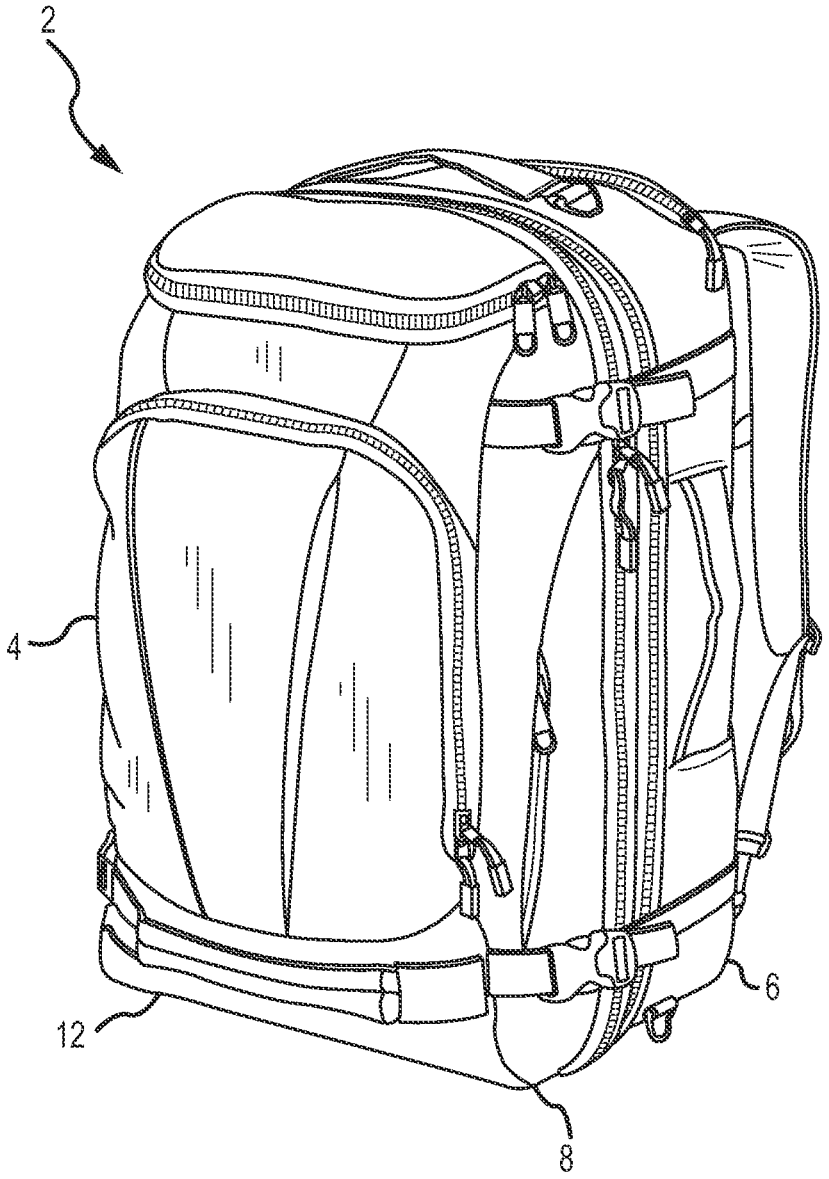
FIG. 1 is a perspective view of a storage device depicting one embodiment of the present invention that is integrated into a luggage item.
Figure 2:
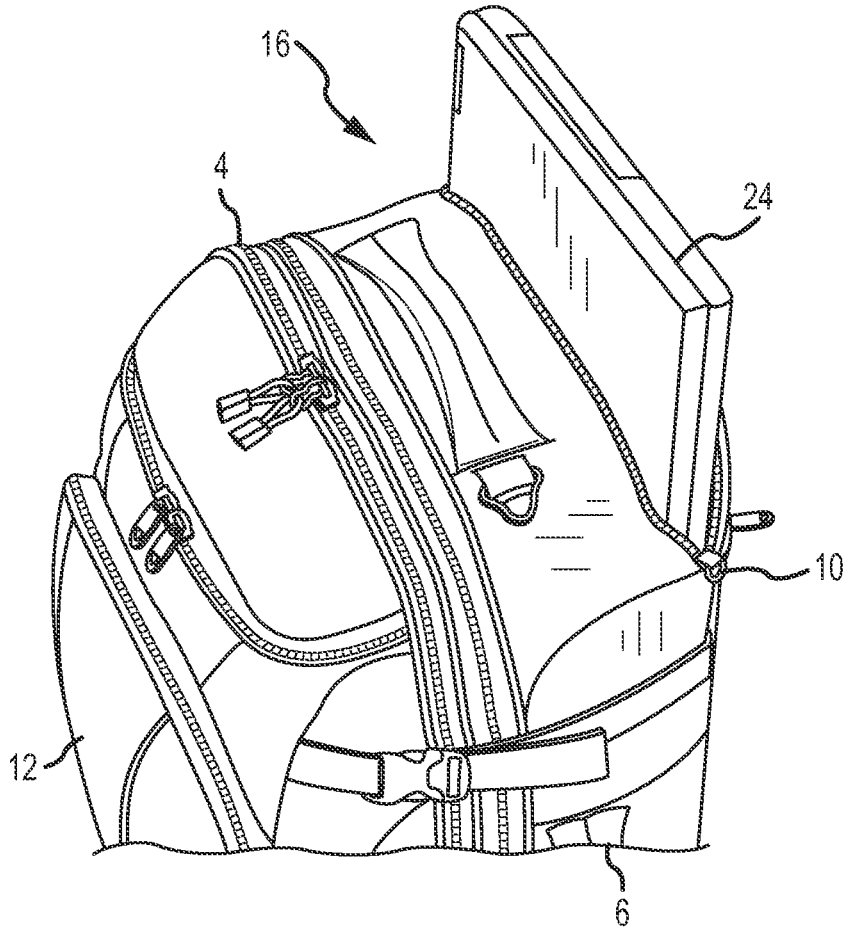
FIG. 2 is a detailed perspective view of FIG. 1, showing the storage device.
Figure 3:
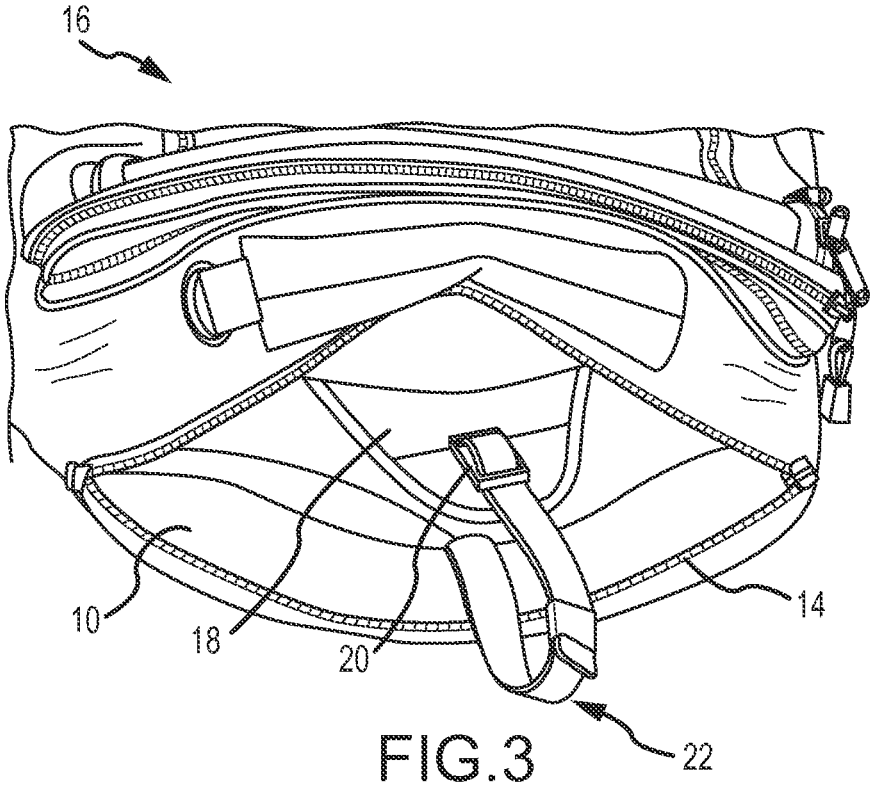
FIG. 3 is a top plan view of FIG. 1, showing the internal configuration of the storage device.
Figure 4:
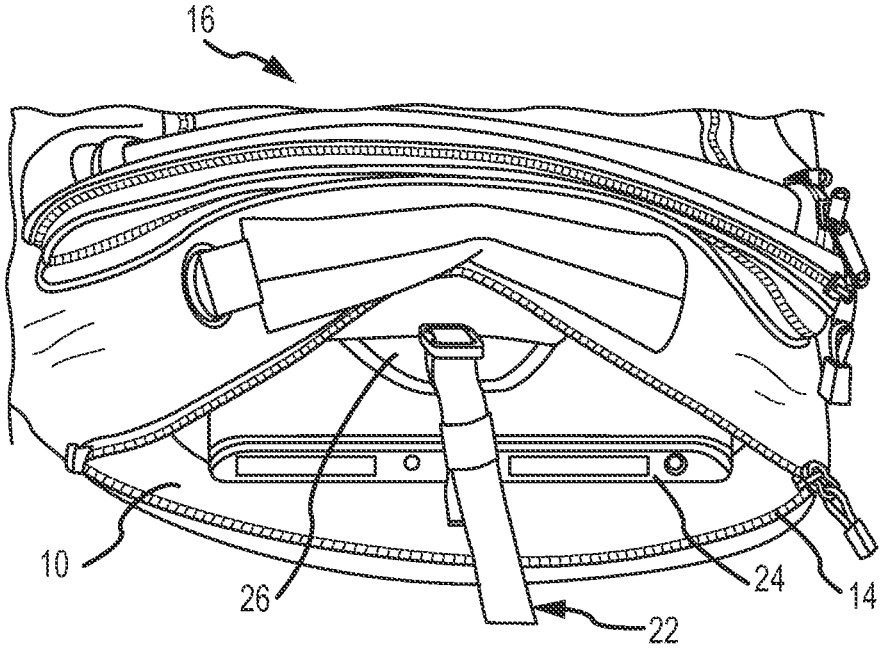
FIG. 4 is a top plan view of FIG. 1, showing a stored laptop computer.
Figure 5:
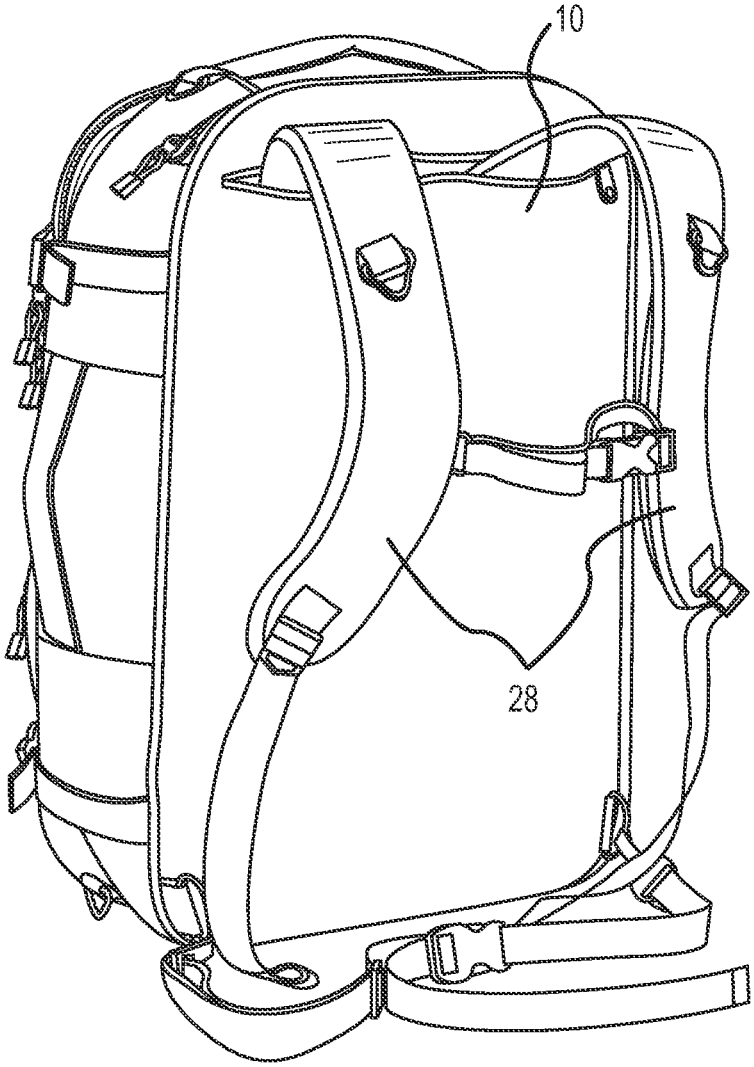
FIG. 5 is a rear perspective view of FIG. 1, showing the shoulder straps and rear view of one embodiment of the present invention.
Figure 6:
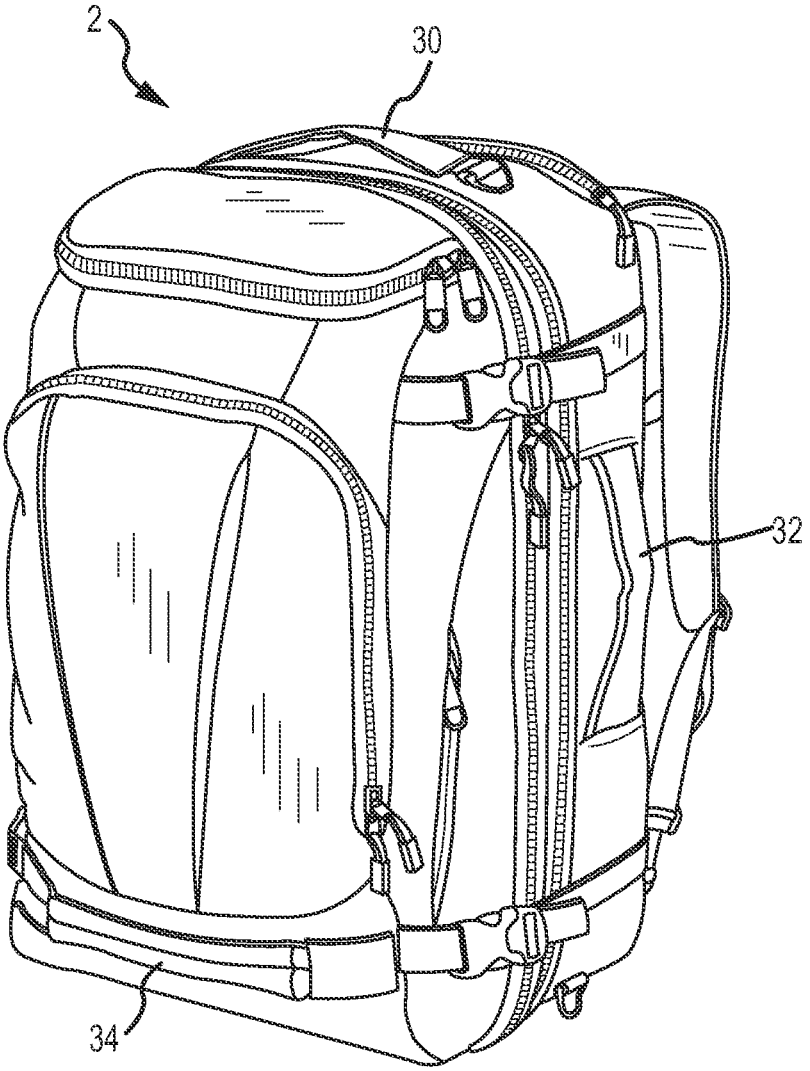
FIG. 6 is a front perspective view of the weekender of one embodiment of the present invention.

As will be appreciated by one skilled in the art, the drawings are not necessarily to scale. In certain instances, details that are not necessary for an understanding of the invention or that render other details difficult to perceive may have been omitted. It should be understood, of course, that the invention is not necessarily limited to the particular embodiments illustrated herein.

DETAILED DESCRIPTION

Referring now to FIGS. 1-9, a luggage item and storage device of one embodiment of the present invention is shown. Embodiments of the present invention are integrated into a weekender type bag for illustration purposes. One skilled in the art will appreciate that weekender bags of this type are suited for short trips, overnight stays, and other traveling.

The weekender 2 generally includes a plurality of external panels, such as, a left panel 4, a right panel 6, a bottom panel 8, a rear panel 10, and a front panel 12, that define a plurality of storage areas/interior compartments. The weekender 2 may also include a plurality of interior panels which further define the storage areas. The plurality of external panels are selectively interconnected to a plurality of zip fasteners 14 (i.e., zippers) to provide access into the interior portions of the weekender bag. One skilled in the art will appreciate that similar interconnection mechanisms may be employed, such as ziplocs, snaps, buttons, magnets, hook and loop fasteners, etc. The zippers are interconnected to zipper pulls that allow for easy opening of the weekender 2. One of skill in the art will also appreciate that for added security, the zipper pulls may further comprise a locking feature, such as a pad lock, to lock the weekender 2.

The rear panel 10 stabilizes the weekender against a user's back. The rear panel 10 is interconnected to the left 4 and right panels 6 and at least one interior panel and forms a compartment adapted to secure and store a laptop computer. In the embodiment shown, an additional zipper 14 is employed on the top of the rear panel to provide selective access to the laptop storage device 16. One of skill in the art will appreciate that top-loading allows quick and easy removal and replacement of the stored laptop computer. Moreover, top-loading reduces the risk of unintended spillage of the laptop computer and centralizes the weight distribution. The rear panel of the weekender is preferably made of a shock-absorbing material, such as ethylene-vinyl acetate ("EVA") foam, to protect the laptop if it is dropped/bumped onto a hard surface.

In various embodiments, the weekender 2 is provided with one or more handles 30, 32, 34 for carrying and/or manipulating the bag. As the weekender 2 may be carried in a number of different positions based upon which handle 30, 32, 34 is used, there is a need for a secure laptop/device containment features. Such features are provided by the present invention as shown and described herein.

Figure 7:
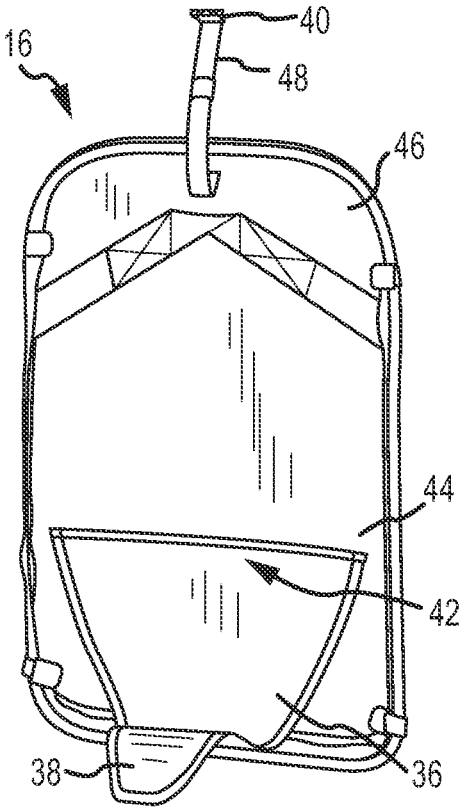
FIG. 7 is a front elevation view of an interior cradle of one embodiment of the present invention.
Figure 8:
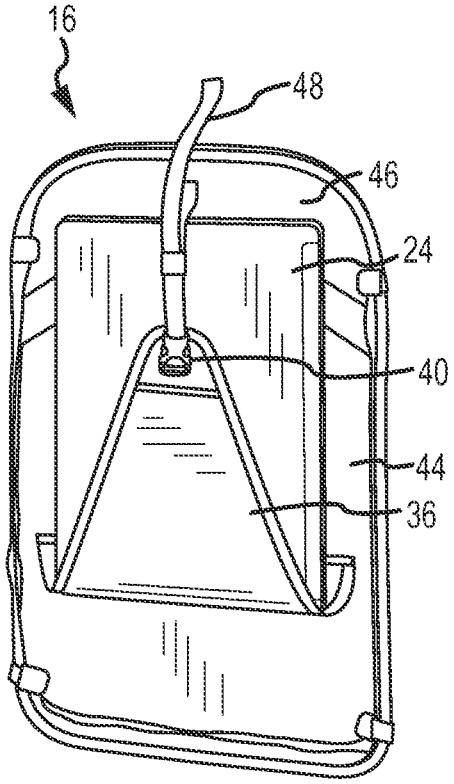
FIG. 8 is a front elevation view of the interior cradle of one embodiment of the present invention.

Referring specifically now to FIGS. 7-9, the laptop storage device 16 of one embodiment of the present invention is shown. The laptop storage device 16 includes at least one interior cradle 36 having a generally arrowhead shape, although one skilled in the art will appreciate that other geometric shapes may be employed. This interior cradle's shape allows for the selective insertion and removal of a laptop computer 24 having various dimensions since the shape of the interior cradle 36 will provide space to allow a user to access the laptop computer 24. The shape of the interior cradle 36 is also adapted to prevent twisting and/or sliding of the stored laptop computer 24 within the weekender 2.

The interior cradle 36 is preferably made of a compliant material and is designed to separate and secure the laptop computer 24 from the remainder of the weekender bag 2. One of skill in the art will appreciate that the interior cradle 36 may be made from any number of strong, flexible, compliant materials, such as, nylon, burlap, leather, or neoprene. Moreover, it is envisioned that the interior cradle 36 may be made of any material that will conform to, secure and protect a stored laptop computer 24. One skilled in the art will also appreciate that the interior cradle may be made from, partially or exclusively, a softer foam material that selectively conforms to the shape of a stored laptop 24. In another embodiment of the present invention, the interior cradle 36 has a shape commensurate with the shape of common laptop computers.

In various embodiments, the interior cradle 36 provides the ability to slide an electronic device in and out of the cradle 36 and/or bag 2 without snagging or becoming constricted. Thus, in various embodiments, the interior cradle 36 comprises one or more low-friction materials, such as Dacron, PET, or polyester for assisting in removal and insertion of an electronic device, as well as allowing the cradle to slide over portions of the device, such as when cradle height is adjusted while the device is disposed therein.

One of skill in the art will appreciate the interior cradle 36 is dimensionally sized to accommodate a wide variety of laptop sizes. That is, the interior cradle 36 is preferably sized to accommodate small and large, thick and thin laptop computers.

The leading edge 38 of the interior cradle 36 further includes a female portion of a sliding buckle 40 or other fastening device. One of skill in the art will appreciate that the leading edge 38 of the interior cradle 36 may include any number of mechanical fastening devices.

The trailing edge 42 of the interior cradle is interconnected to the rear panel 44. The trailing edge 42 of the interior cradle 36 may optionally interconnect to a back wall 46 which is then interconnected to the rear panel 44. The back wall 46 may be interconnected to the interior cradle 36 and rear panel 44 using any common means for fastening flexible materials, such as, sewing, gluing (or other adhesives), snaps, buttons, hook and loop material, or zippers. Alternatively, as can be appreciated by one skilled in the art, the interior cradle 36 can be positioned within any number of compartments which may comprise the weekender 2 or other bag/carrying case. For example, the trailing edge 42 of the interior cradle 36 may be interconnected to any one or more of the plurality of external and/or internal panels.

The height of the interior cradle is adjusted using a strap 48. In one embodiment, the strap 48 is interconnected to the back wall 46 at a point vertically above the leading edge 38 of the interior cradle 36. In another embodiment, the strap 48 is interconnected to the rear panel 44 at a point vertically above the leading edge 38 of the interior cradle 36. The corresponding male portion of the buckle 40 is interconnected to the strap 48. One of skill in the art will appreciate that any number of fastening devices may also be used in lieu of or in addition to a buckle, such as hook and loop strips, clips, clasps, buttons, magnets, snaps, or zippers. As used herein, interconnection means refers to any such device as will be apparent to one of ordinary skill in the art as being suitable for assisting in the functions of joining two portions of an adjustable strap or joining an adjustable strap to a cradle portion and further enabling the adjustable strap to alter a height of the cradle and corresponding vertical storage position of a device to be stored therein. Thus, the present invention is not limited to a specific buckle or fastening device.

With reference to FIG. 8, when a laptop computer 24 is positioned against the surface of the interior cradle 36, the material extending below the laptop is wrapped around portions of the back, bottom, and front of the laptop. The strap and buckle are used to secure the laptop computer within the interior cradle 36.

Figure 9A:
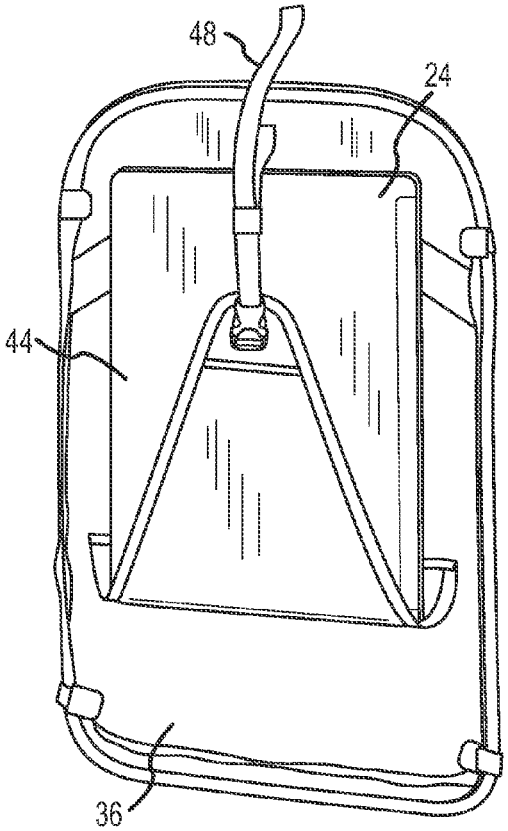
FIGS. 9A and 9B are front elevation views of the interior cradle of one embodiment of the present invention, shown at varying heights.
Figure 9B:
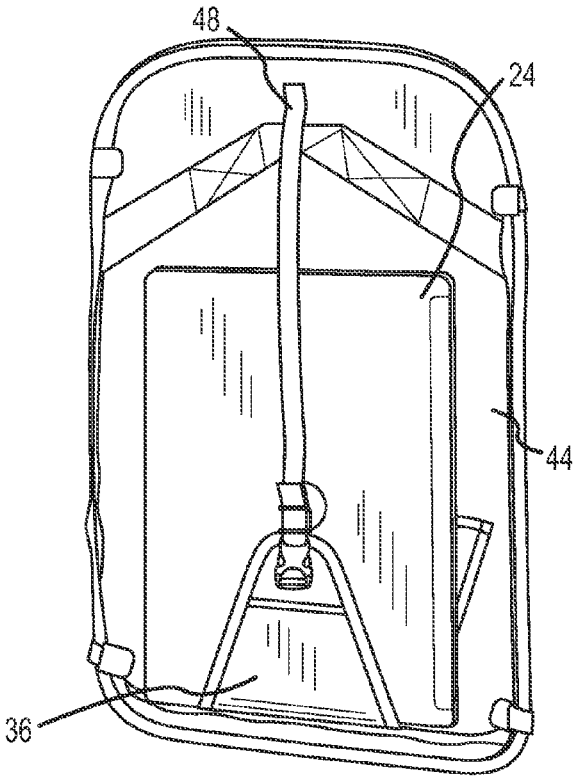

As shown in FIGS. 9A-9B, shortening or lengthening the strap 48 raises or lowers the laptop computer against the rear panel 44 and/or back wall 46. One of skill in the art will appreciate that when secured, the laptop's weight is carried by the rear panel and/or back wall. In one embodiment, the strap 48 is preferably short enough to secure a 13 inch laptop computer and also long enough to secure a 17 inch laptop computer. As can be appreciated by one skilled in the art, the strap 48 may be made of, among other materials, any number of resilient stretchable fabrics.

One of skill in the art will appreciate that the interior cradle 36 may be padded or have foam protection such that if the bag is dropped, the laptop computer 24 will be protected. Moreover, the interior cradle 36 may be made of a shock absorbing material, such as a stretchable elastic material, or neoprene to further protect the laptop computer 24. In a preferred embodiment, the interior cradle 36 is positioned within a bag 2 such that a lowermost portion of the device to be stored within the cradle is positioned above a bottom portion of the bag. In such a preferred embodiment, devices stored within the bag are provided with additional impact protection (for example, in the event that the bag is dropped) due to the device's elevation from a lower portion of the bag 2. One of skill in the art will recognize that such an arrangement provides impact protection for the device as shock or impact will be absorbed through portions of the bag as opposed to being imparted directly upon the electronic device.

In one embodiment of the present invention, a laptop computer 24 is stowed by inserting it into the interior cradle 36, grasping the leading edge 38 of the interior cradle 36 with one hand to raise it to its upper-most height, and then connecting the male and female components of the buckle 40. One of skill in the art will appreciate that once the laptop 24 is stowed at the upper-most height, any vertical movement of the laptop will be minimized and/or eliminated. Moreover, as will be appreciated by most busy travelers, the laptop storage system 16 provided is quick and convenient because once the length of the interior cradle's strap is adjusted, the laptop may be repeatedly stowed and retrieved with relative ease.

One of skill in the art will appreciate the versatility the interior cradle 36 provides. For example, the interior cradle may be used to store other portable electronic devices (i.e., DVD players, iPods/MP3 players, GPS units, camcorders, cameras), computer accessories (i.e., electric cords, AC adapters, CDs/DVDs, electric cords), office supplies (i.e., files, folders, notebooks, magazines and other reading material), pet and/or baby supplies, or other objects requiring easy accessibility (i.e., passports, visas, boarding tickets, maps, eye glasses, toiletries, shoes, umbrellas, earphones, medicine, snacks).

As stated above, the laptop computer 24 is protected by a padded rear panel 44. Once the remainder of the weekender 2 is packed, the remaining sides of the laptop will be further protected by the person contents (i.e., clothing) in the interior compartments of the bag 2.

As can be appreciated by busy travelers, there is no loss of critical cubic volume if a laptop computer 24 is not packed. Since the interior cradle 36 is preferably flexible and unobtrusive, if no laptop computer is packed, the compartment can be compressed and packed flat against the rear panel 44.

Accordingly, in various embodiments of the present invention, a laptop storage system 16 is provided wherein the system comprises an at least partially isolated compartment (e.g. with respect to additional bag compartments) for a laptop computer 24 or similar device. The system 16 comprises a cradle 36 of predetermined size securely connected to a rear panel 44 or back wall 46 portion of the bag at a first end and optionally connected to an adjustable strap 48 via a buckle 40 or similar device at a second end. The adjustable strap 48 is further secured to a back wall 46 or rear panel 44 portion at one end. Thus, in one embodiment, a laptop storage system is provided wherein a laptop 24 may be disposed in an interior cradle 36 and at least a vertical position of the laptop 24 with respect to the bag 2 may be selectively positioned based upon user preference. As one of ordinary skill in the art will recognize, such novel feature(s) allow for variable positioning of a laptop as well as secure and convenient storage of various different sized devices.

Referring back to FIGS. 4-6, the laptop storage system is transported using the weekender's carrying straps 28 and/or handles 30, 32, 34. As shown, the weekender 2 includes a plurality of straps 28 for carrying. As shown, the weekender 2 includes a shoulder strap system interconnected to the rear panel 44 for securement of the weekender 2 to the traveler's shoulders. One of skill in the art will appreciate the comfort added by a shoulder strap system. For added carrying convenience, the weekender also includes a plurality of handles 30, 32, 34, for example, on the top of the weekender and the side panels. In another embodiment of the present invention, for additional comfort and support, the weekender 2 includes a belt and clip combination for fastening around a traveler's waist. One of skill in the art will appreciate that the weekender 2 may include additional straps and/or handles to facilitate easy carrying/grasping of the weekender.

In addition, the weekender 2 of at least one embodiment of the present invention is lightweight and easily transportable. For example, a traveler may more easily take a laptop with him or her on more trips, if the laptop storage device, such as the interior cradle of the present invention, is lightweight and compactable. In another example, a traveler may use his or her laptop more frequently when the traveler can quickly remove and replace the stored laptop computer.

One of skill in the art will also appreciate that any number of additional luggage/baggage features may be included in the weekender, such as, a hide-away water bottle pocket, a hide-away ID pocket, an exterior forehead pocket, a removable fiddly-bits bag, a mesh headliner section, grab handles, a key leash, etc.

It is envisioned that embodiments of the laptop storage system of the present invention are capable of being integrated into a number of bag styles, such as, a duffle bag, a messenger bag, a backpack, a holster, a rolling bag, a garment bag, a tote bag, etc.

While various embodiment of the present invention have been described in detail, it is apparent that modifications and alterations of those embodiments will occur to those skilled in the art. Moreover, references made herein to "the present invention" or aspects thereof should be understood to mean certain embodiments of the present invention and should not necessarily be construed as limiting all embodiments to a particular description. However, it is to be expressly understood that such modifications and alterations are within the scope and spirit of the present invention, as set forth in the following claims.

What is claimed is:

1. A storage system adapted for selectively positioning and retaining portable electronic devices within the confines of a luggage item, the storage system comprising:

a luggage item having a plurality of panels, including a first panel and a bottom panel, defining a storage compartment accessible by an opening opposite the bottom panel; and a flexible interior cradle inside the storage compartment adapted to wrap around at least a portion of a portable electronic device having a weight, said interior cradle in the form of a second panel having a trailing edge of a first length, a leading edge of a second length less than the first length opposite the trailing edge;

a single adjustable strap inside the storage compartment having a first end and a second end, said first end interconnected to a first panel of said luggage item;

said trailing edge of said interior cradle operably interconnected to said first panel at a location on the first panel above the bottom panel, and wherein said interior cradle is devoid of connections to said first panel other than said single adjustable strap and said trailing edge;

said leading edge of said interior cradle having a first sliding buckle portion and said second end of said adjustable strap having a second sliding buckle portion, said first and second sliding buckle portions being selectively engageable with each other;

wherein said adjustable strap is accessible through the opening and operable by a single action to alter a storage height of a portable electronic device carried by said interior cradle when said first and second sliding buckle portions are engaged by pulling on the second end of the adjustable strap, thereby changing the position of the second slide buckle portion on the adjustable strap;

wherein the storage height of a portable electronic device held by-said interior cradle is selectively adjustable between a maximum height and a minimum height relative to the bottom panel, the maximum height characterized by said interior cradle being entirely above the location of interconnection to the first panel and the minimum height characterized by the interior cradle being entirely above and not in contact with the bottom panel such that the weight of a portable electronic device held by said interior cradle is carried by the first panel.

2. The storage system of claim 1, wherein at least one of said panels comprises a cushioning material to provide impact protection.

3. The storage system of claim 1, wherein the luggage item is at least one of a backpack, a weekender, a messenger bag, a duffle bag, a briefcase, an attachéand a holster.

4. The storage system of claim 1, wherein said storage compartment is at least partially isolated from at least one additional storage compartment of the luggage item.

5. The storage system of claim 1, wherein said interior cradle has two, opposite side edges connecting the leading edge and the trailing edge and wherein the two opposite side edges are linear, thereby giving said interior cradle an arrowhead shape.

6. The storage system of claim 1, wherein said first sliding buckle portion is directly attached to said interior cradle.

7. A storage system adapted for selectively positioning and retaining a portable electronic device within the confines of a luggage item, the storage system comprising:

a luggage item having a plurality of panels defining a storage compartment and a flexible interior cradle adapted to wrap around at least a portion of a portable electronic device, the interior cradle having a trailing edge and a leading edge, the plurality of panels including a first panel;

a single adjustable strap having a first end and a second end, the first end interconnected to the first panel of the luggage item;

the trailing edge of the interior cradle interconnected to the first panel;

the leading edge of the interior cradle having a first buckle portion and the second end of the adjustable strap having a second buckle portion, the first and second buckle portions being selectively engageable with each other and wherein the interior cradle is devoid of connections to the first panel other than the trailing edge and via the single adjustable strap when the first and second buckle portions are engaged; and wherein the adjustable strap is operable in a single action to alter a selectively adjustable height of the interior cradle within the storage compartment when the first and second buckle portions are engaged.

8. The storage system of claim 7, wherein the interior cradle has an arrowhead shape.

9. The storage system of claim 7, wherein the interior cradle comprises at least one of: foam, nylon, burlap, leather and neoprene.

10. The storage system of claim 7, wherein the first end of the adjustable strap is interconnected to the first panel of the luggage item at a location vertically above the leading edge.

11. The storage system of claim 7, wherein when the first and second buckle portions are engaged, weight of the portable electronic device is carried by the first panel regardless of the adjusted height of the interior cradle.

12. The storage system of claim 7, wherein the storage compartment is at least partially isolated from at least one additional storage compartment of the luggage item.

13. The storage system of claim 7, wherein, when the first and second buckle portions are engaged, the adjustable height of the interior cradle may be altered by pulling on the second end of the adjustable strap, thereby changing the position of the second buckle portion on the adjustable strap.

14. A storage system adapted for selectively positioning and retaining portable electronic devices within the confines of a luggage item, the storage system comprising:

a luggage item having an internal volume defined by a plurality of panels;

the internal volume having a first storage compartment and a second storage compartment, the first and second storage compartments at least partially separated by a divider portion;

the second storage compartment adapted to receive a portable electronic device having a weight, wherein the second storage compartment includes:

a flexible interior cradle adapted to wrap around at least a portion of the portable electronic device, the interior cradle having a trailing edge and a leading edge;

an adjustable strap having a first end and a second end, the first end interconnected to the divider portion; and a bottom panel;

the trailing edge of the interior cradle operably interconnected to the divider portion;

the leading edge of the interior cradle having a first buckle portion and the second end of the adjustable strap having a second buckle portion, the first and second buckle portions being selectively engageable with each other and wherein the interior cradle is devoid of connections to the divider portion other than the trailing edge and via the adjustable strap when the first and second buckle portions are engaged;

wherein the adjustable strap is operable in a single action to alter a selectively adjustable height of the interior cradle when the first and second buckle portions are engaged; and wherein the selectively adjustable height of the interior cradle is adjustable between a minimum height and a maximum height relative to the bottom panel, the minimum height characterized by the interior cradle being entirely above and not in contact with the bottom panel such that a weight of the portable electronic device carried by the interior cradle is carried by the divider portion.

15. The storage system of claim 14, wherein the first end of the adjustable strap is interconnected to the divider portion at a location vertically above the leading edge.

16. The storage system of claim 14, wherein, when the first and second buckle portions are engaged, the adjustable height of the interior cradle may be altered by pulling on the second end of the adjustable strap, thereby changing the position of the second buckle portion on the adjustable strap.

17. The storage system of claim 14, wherein the first storage compartment and the second storage compartment comprises at least one of padding and foam.

18. The storage system of claim 14, wherein, when the first and second buckle portions are engaged, weight of the portable electronic device is carried by the first panel regardless of the adjusted height of the interior cradle.

19. The storage system of claim 14, wherein the maximum height is characterized by said interior cradle being entirely above the location of interconnection to the first panel.

* * * * *